US005588268A

United States Patent [19]

Sterflinger et al.

[11] Patent Number: 5,588,268

[45] Date of Patent: Dec. 31, 1996

[54] PLATE ELEMENT FOR A BUILDING PANEL ASSEMBLY

[75] Inventors: Fritz Sterflinger, Papenburg; Hans Möhlenkamp, Sögel, both of Germany

[73] Assignee: Jos. L. Meyer Werft GmbH & Co., Papenburg, Germany

[21] Appl. No.: 392,759

[22] PCT Filed: Jun. 17, 1994

[86] PCT No.: PCT/DE94/00692

§ 371 Date: Feb. 22, 1995

§ 102(e) Date: Feb. 22, 1995

[87] PCT Pub. No.: WO95/00725

PCT Pub. Date: Jan. 5, 1995

[30] Foreign Application Priority Data

Jun. 23, 1993 [DE] Germany ..... 43 20 740.5
Dec. 22, 1993 [DE] Germany ..... 43 43 859.8

[51] Int. Cl.[6] ..... E04B 5/10; E04C 2/08; E04C 2/36; B63B 3/48

[52] U.S. Cl. ..... 52/236.7; 52/236.3; 52/263; 114/85

[58] Field of Search ..... 428/593, 598, 428/596, 624, 626; 52/793.1, 793.11, 236.3, 236.7, 236.9, 630, 654.1, 579, 580, 263, 264; 114/85; 228/181

[56] References Cited

U.S. PATENT DOCUMENTS

| | | | |
|---|---|---|---|
| 2,186,538 | 1/1940 | Slayter et al. | 52/264 |
| 2,607,447 | 8/1952 | Tuttle | 52/793.1 |
| 3,184,013 | 5/1965 | Pavlecka | 189/34 |
| 3,385,182 | 5/1968 | Harvey | 52/579 |
| 3,386,218 | 6/1968 | Scott | 52/794.1 |
| 3,450,010 | 6/1969 | Harvey | 52/579 |
| 3,538,819 | 11/1970 | Gould et al. | 52/579 |
| 3,827,203 | 8/1974 | Berrie | 52/263 |
| 3,998,024 | 12/1976 | Frandsen | 52/794.1 |
| 4,598,517 | 7/1986 | Alvarsson | 52/263 |
| 4,603,089 | 7/1986 | Bampton | 428/593 |
| 4,918,895 | 4/1990 | Landheer | 52/580 |
| 4,936,069 | 6/1990 | Hunter et al. | 52/794.1 |

FOREIGN PATENT DOCUMENTS

| | | | |
|---|---|---|---|
| 1159836 | 7/1958 | France | 52/793.11 |
| 2628135 | 9/1989 | France | 52/793.1 |
| 821542 | 10/1951 | Germany . | |
| 1962274 | 7/1971 | Germany . | |
| 2526723 | 12/1976 | Germany | 52/263 |
| 8702086 | 4/1987 | United Kingdom . | |

*Primary Examiner*—John Zimmerman
*Attorney, Agent, or Firm*—Collard & Roe P.C.

[57] ABSTRACT

In a plate element, in particular made of steel, consisting of two parallel outer sheets which are connected firmly to one another by means of interposed web plates which are welded to the outer sheets, each web plate is a strip whose longitudinal edges are butt-jointed to the respectively facing inner surface of the respective outer sheet. The welding formed in each case by a weld, in particular a laser weld, which extends through the respective outer sheet into the abutting longitudinal edge of the respective web plate strip. The outer sheets are cut into rectangles and the web plate strips are interposed in each case running parallel to the longer rectangular sides of the outer sheets.

2 Claims, 5 Drawing Sheets

PLATE ELEMENT FOR A BUILDING PANEL ASSEMBLY

BACKGROUND OF THE INVENTION

1. Field of the Invention

The invention relates to a plate element, in particular made of steel, consisting of two parallel outer sheets which are connected firmly to one another by means of interposed web plates which are welded to the outer sheets.

2. The Prior Art

A plate element of the generic type described above is described in the European Patent 0,238,603. In the known plate element, there are web plates in the form of a corrugated plate, where the ridges of the corrugations are welded to the outer sheets. The manufacture of the known plate element is relatively complicated and expensive. It is almost impossible to manufacture a sheet-metal plate with a precisely uniform corrugation. When the plate element is being fitted together, slight pressure on the corrugation may cause a change in the ridge heights and thus in the distance between the outer sheets. The known plate element is constructed in a disadvantageous manner during its manufacturing process, i.e. the hollows of the corrugations are connected firstly from the inside by a weld extending right into the inner surface of a first outer sheet resting against them. The second outer sheet is then placed on the ridges of the corrugations, and a second weld is welded from the outside through the outer sheet, extending right into the ridges. Manufacturing the known plate element therefore requires individual process steps to be carried out successively. Any deviations occurring in each individual process step may cumulatively result in the manufacture of a plate element of little precision. Furthermore, the corrugations have the additional disadvantage that it will hardly be possible to make an opening in a finished plate element using cutting tools.

SUMMARY OF THE INVENTION

The invention is based on the object of providing a plate element which, with the possibility of a simple, but nevertheless precise manufacture, can be mounted and finished easily and can be used in a versatile manner.

This object is achieved according to the invention in that each web plate is a strip whose longitudinal edges are butt-joined to the respectively facing inner surface of the respective outer sheet, and in that the welding is formed in each case by a weld which extends through the respective outer sheet into the abutting longitudinal edge of the respective web plate strip.

Web plate strips can be cut to size with sufficient precision in respect of their dimensions. The web plate strips are butt-joined with the outer sheets and fixed, in particular, by means of a laser weld which extends from the outside through the respective outer sheet into the longitudinal edge of the respective web plate strip. Electrowelding by means of spot or wheel electrodes—or even bonding—is also conceivable. A plate element made of steel sheet can thus be manufactured quickly and precisely, which is relatively insensitive to compression forces acting from the outside during the manufacturing process since the individual web plate strips are disposed perpendicular to the outer sheets and can absorb corresponding compression forces acting on the outer sheets better than a corrugated web plate.

According to a preferred development, the outer sheets are cut into rectangles and the web plate strips are interposed in each case running parallel to the longer rectangular sides of the outer sheets. The rectangular shape of the plate elements permits the plate elements to be used as wall and/or floor elements. For example, a panel-like wall covering can be effected in shipbuilding. A ship's deck can be produced using the plate elements according to the invention, in that said plate elements are laid in the manner of planks over corresponding lower chords.

According to a further advantageous development, the long rectangular sides of the outer sheets are extended by a predetermined amount beyond the respective outermost web plate strips so that the outer sheets have a projection.

It is particularly advantageous for a tongue element, which protrudes beyond the assigned edge of the outer sheets, to be inserted in each case into one of the compartments bounded by the projection of the outer sheets beyond the outermost web plate strips. The projection on the side of the plate element opposite the tongue element can readily be used as a groove so that the plate elements according to the invention can be placed against one another or laid with a tongue-and-groove connection. Since the web plate strips run parallel to the longer rectangular sides of the outer sheets, a tongue-and-groove connection is also possible where a plate element according to the invention is shortened in its width, which is not unlikely in the case of corresponding usages as a wall or floor coverings.

The plate elements according to the invention can therefore be manufactured to have a standard size, for example a width of one meter, and can be obtained, prefabricated in this manner, by a processing company, e.g. a shipyard, which produces decks, cargo holds and other configurations with said plate elements in a ship. However, the application is not restricted to ship-building. Further advantageous applications of the plate element are also conceivable in vehicle construction, aircraft construction, container construction and the like.

The tongue element is advantageously a rectangular tube which is welded in to fit between the outer sheets. In this case, the rectangular tube is dimensioned such that it fits between the outer sheets forming a groove of a plate element to be attached. The advantage thus results for the user of the plate elements according to the invention that tolerances are possible during the installation of the plate elements, and a compensation of thermal expansions can readily take place via the tongue-and-groove connections of the plate elements.

Of course, any other desired, suitable profile can also be used as tongue element. Furthermore, the tongue element does not necessarily have to continue over the entire length of the plate element. A tongue element, for example the rectangular tube, can also be arranged distributed in sections over the length of the plate element.

It has been found that a thickness of the outer sheets of approximately 3 mm and of the web plate strips of approximately 4 mm results in a sufficiently sturdy plate element, the web plate strips preferably being arranged parallel to one another at a distance of 120 mm. Each web plate strip is approximately 40 mm high. A plate element made of steel and having the dimensions specified has a relatively low weight and can be processed without difficulty, which has favorable effects in terms of cost, in particular in shipbuilding.

According to a further development for which independent protection is also claimed, the plate element according to the invention is distinguished by the fact that each web plate strip is provided with an insulating separation.

A plate element having web plate strips of this type has particularly advantageous insulating characteristics, in that the cold or hot thermal bridges, occurring in the case of integral web plate strips made of steel disposed between the outer sheets, are avoided.

For thermal separation, a profile can be used, which is manufactured from a material with a low co-efficient of thermal conduction.

As a side effect of the thermal separation, the designer applying the plate element according to the invention can also use the characteristic that the outer sheets of a plate element which are thermally separated from one another can also be electrically insulated from one another if corresponding insulating materials are selected. Additionally, the separation can also be effected for sound-damping.

Each web plate strip consists of two partial strips which are separated from one another and whose outer longitudinal edges are butt-joined and welded or bonded to the respective outer sheets, as described above. At least one profile made of insulating material is placed between the mutually facing free inner longitudinal edges of the partial strips. Web plate strips consisting of two partial strips with an interposed insulating separation can be prefabricated without difficulty and processed during the manufacture of the plate elements.

The mutually facing longitudinal edges of the partial strips and the respectively assigned outer surface regions of a profile can be equipped with connecting members which can be brought into mutual engagement. The connecting members can be positive engagement elements, e.g. tongue and groove, which are molded onto the longitudinal edges of the partial strips and of the profiles. Of course, bonding connections, screw or rivet connections and other suitable types of connection can also be selected, which guarantee a sufficient strength of the connection between a thermal separation comprising at least one profile made of insulating material and the partial strips of a web plate strip made of steel.

A tongue element, e.g. a rectangular tube fitted between the outer sheets, which is inserted into a compartment bounded by the projection of the outer sheets beyond the outermost web plate strips can likewise be provided with an insulating separation. A rectangular tube can be fitted together, e.g. from two U-shaped metal profiles, in such a way that the free ends of the U-limbs butt against one another with interposition of strips made of insulating material.

In the plate element according to the invention, the compartments formed by the outer sheets and respectively adjacent web plate strips can also be filled with insulating or damping material. Apart from sound-damping and thermal insulation, an advantageous fire protection can also be achieved by the use of suitable materials. The materials can be introduced into the compartments formed between the outer sheets in an advantageously simple manner by means of a foam-filling. Foam-filling of the compartments also has the advantage that, e.g. when openings through the plate elements are produced using cutting tools, the chips are retained in the foam-filling. This effect is particularly advantageous in shipbuilding since chips lying freely in the compartments would slip back and forth during later movements of the ship and would produce corresponding noises.

The advantageous possibility of readily being able to introduce openings into this plate element permits a cutout to be made in the region of a passage, for example for a shaft and/or for tubes, into which cutout an insert can be inserted, which has construction elements to be passed through. The insert can advantageously be prefabricated. The plate element is equipped with the insert and, e.g. in shipbuilding, the tubes can then be connected without difficulty to the construction elements of the insert to be passed through. Of course, inserts can simply be welded to the plate elements since the plate elements are likewise made of steel.

If the plate element is laid on lower chords of a support construction, a cutout can be made in the plate element at a predetermined place directly above a lower chord. A foot part of a support can be installed in the cutout. Since the plate element itself would not be able to withstand the compression forces introduced via a support, the pressure is conducted via the foot part from the support onto the lower chord and absorbed directly by the lower chord.

The foot part is preferably a tubular piece which is inserted into the cutout of the plate element, stands on the lower chord, is welded to the lower chord from the inside, and has a collar flange which rests on the upper outer sheet. The collar flange can, in turn, be welded to the outer sheet, it being possible for the foot of a support, in turn, to be welded to the collar flange.

BRIEF DESCRIPTION OF THE DRAWINGS

Exemplary embodiments of the invention, from which further innovative features emerge, are illustrated in the drawing, in which.

DETAILED DESCRIPTION OF THE PREFERRED EMBODIMENT

Figure 1:
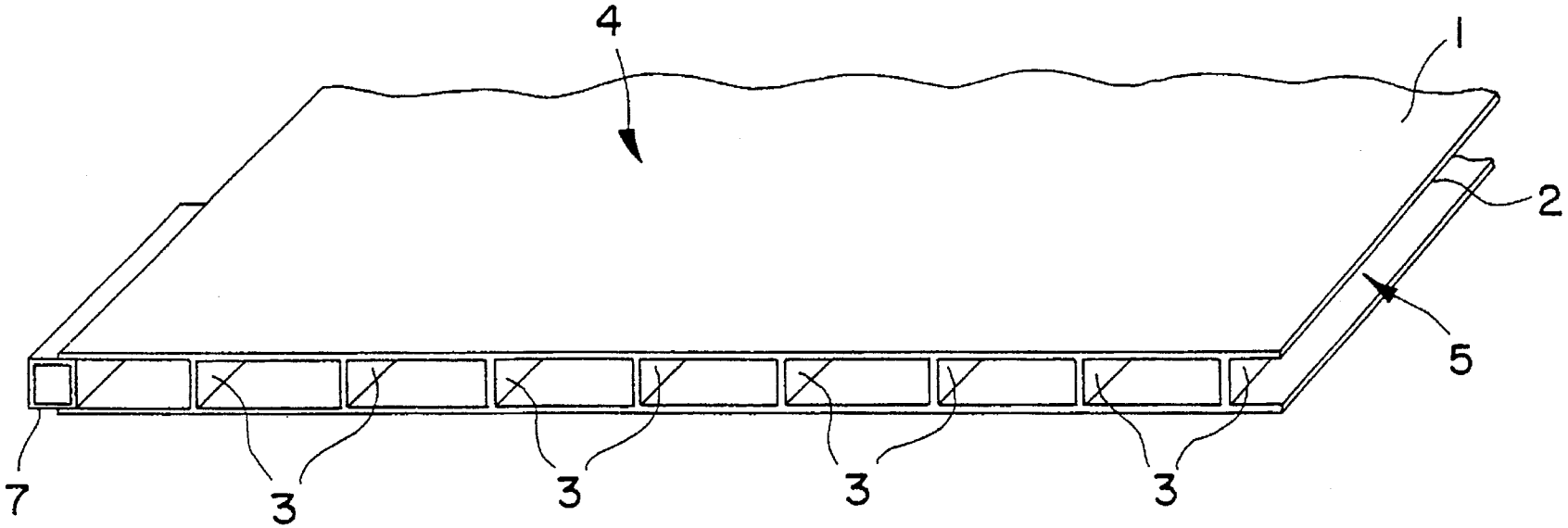
FIG. 1 is a partial view of a plate element.

FIG. 1 illustrates a plate element 4 in a diagrammatic partial view. The plate element 4 consists of two parallel outer sheets 1 and 2 and a multiplicity of interposed web plates 3 which are welded to the outer sheets 1 and 2.

Due to the outer sheets being cut into rectangles, a rectangular plate element 4 results, in which the web plate strips 3 each run parallel to the longer rectangular sides of the outer sheets 1, 2. The long rectangular sides of the outer sheets project by a predetermined amount beyond the respective outermost web plate strips 3, as a result of which a compartment is formed on the right-hand side of the plate element 4, which compartment serves as a groove 5. Inserted into a compartment on the left-hand long rectangular side (FIG. 1*a*) is a tongue element 6 which in this case consists of a rectangular tube 7 which is welded in to fit between the outer sheets 1 and 2.

Figure 1A:
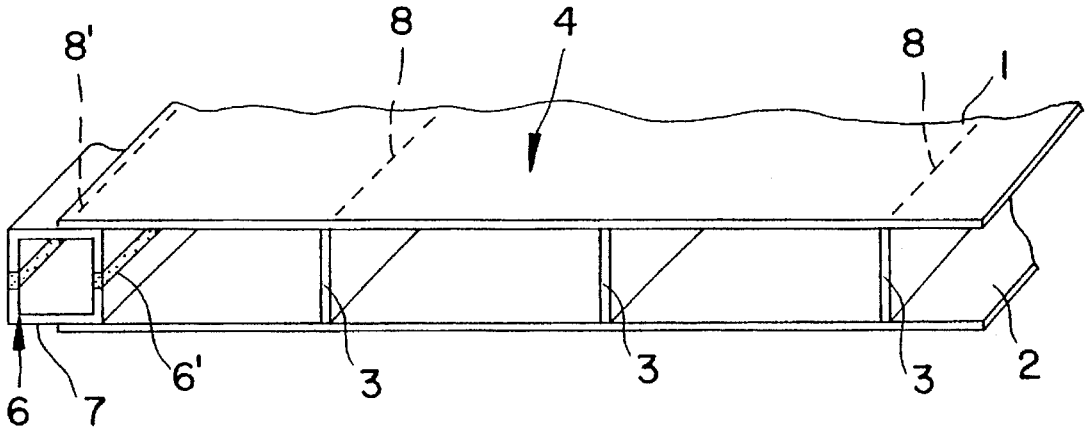
FIG. 1*a* is a left edge region of the plate element according to FIG. 1 on an enlarged scale.

FIG. 1*a* shows the left-hand region of the plate element 4 according to FIG. 1 on an enlarged scale. Identical components are denoted by identical reference numerals. FIG. 1*a* shows clearly that the web plate strips 3 are butt-welded to the outer sheets i and 2 by a laser weld 8. The rectangular profile tube 7 serving as tongue element 6 is also welded to the outer sheets 1 and 2 by a laser weld 8'. The rectangular profile has interposed strips 6' of insulating material for the insulating separation.

Figure 2:
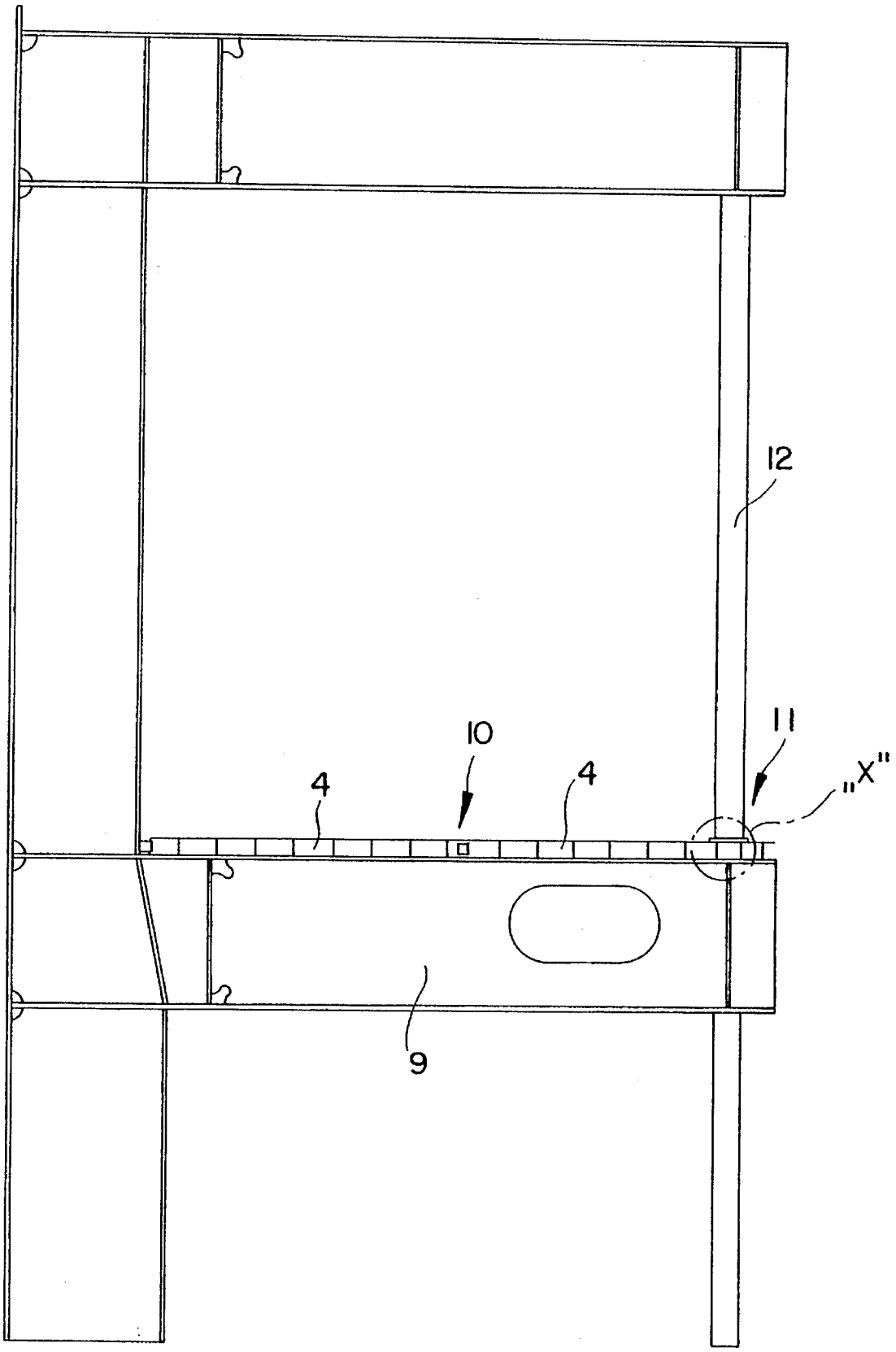
FIG. 2 is a lateral view of an installation example of the plate elements in a support construction.

FIG. 2 shows a diagrammatic view of an exemplary embodiment, in which plate elements 4 are used to form a ship's deck, the plate elements 4 resting on a lower chord 9 of the support construction of the ship's hull. FIG. 2 shows clearly that the plate elements 4 engage in one another mutually in the joint region 10 owing to the formation of groove 5 and tongue element 6 (FIG. 1).

Figure 3:
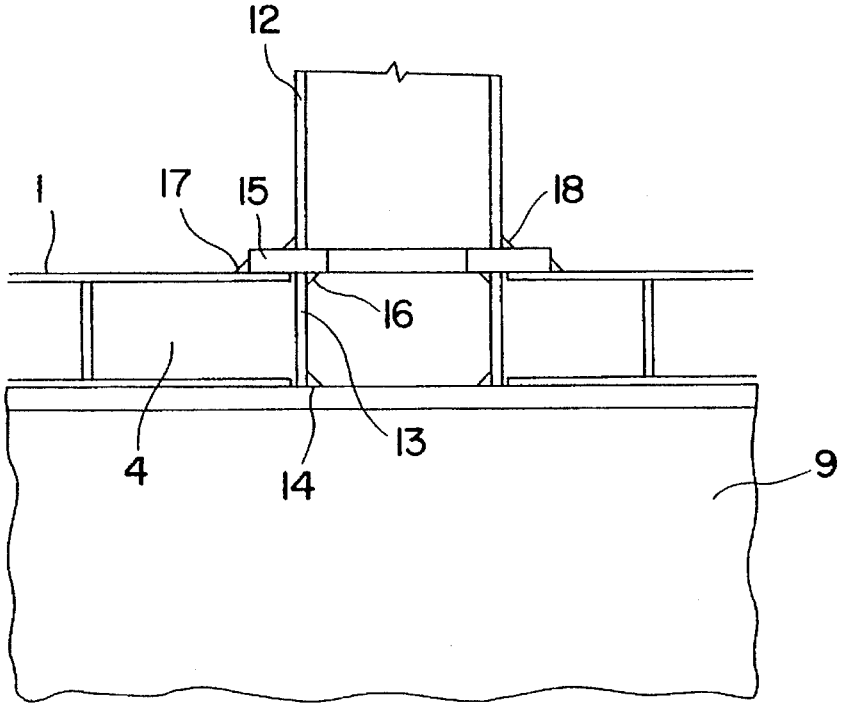
FIG. 3 is the detail, marked in FIG. 2 by a circle "x", on an enlarged scale.

In the foot region 11 of a support 12, the plate element 4 has a cutout through which the foot region 11 of the support can be inserted so that supporting forces can be absorbed directly by the lower chord 9. The foot region 11 is marked by a circle "x" and is illustrated in FIG. 3 on an enlarged scale. A tubular piece standing on the lower chord 9 is inserted into the cutout which is introduced into the plate element 4, for example bored or milled by machining. For the connection to the lower chord, the tubular piece can be welded to the lower chord by means of the welds 14 applied from the inside. A collar flange 15 can be welded onto the upper edge of the tubular piece, which collar flange has previously already been connected to the tubular piece by means of the welds 16 and is subsequently connected to the outer plate 1 by the weld 17. The support 12, which is cut to a corresponding length and likewise consists of a tube, can then be connected to the collar flange 15 by means of a weld 18. Supporting forces of the support 12 are thus conducted directly onto the lower chord 9. On the plate element 4 according to the invention, the support is fixed merely by the welds 17.

Figure 4:
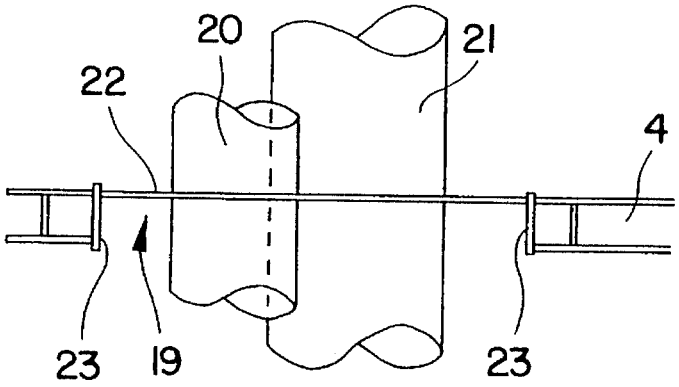
FIG. 4 is a section through a plate element in the region of an opening with an insert for tube passages.

FIG. 4 shows a diagrammatic sectional view of a plate element in the region of a passage 19 for tubes 20 and 21. An insert 22 in the form of a prefabricated steel plate with lateral edge webs 23 is inserted into a cutout in the plate element 4, which cutout has been produced by machining or by burning. The attachment can be effected by welds.

Figure 5:
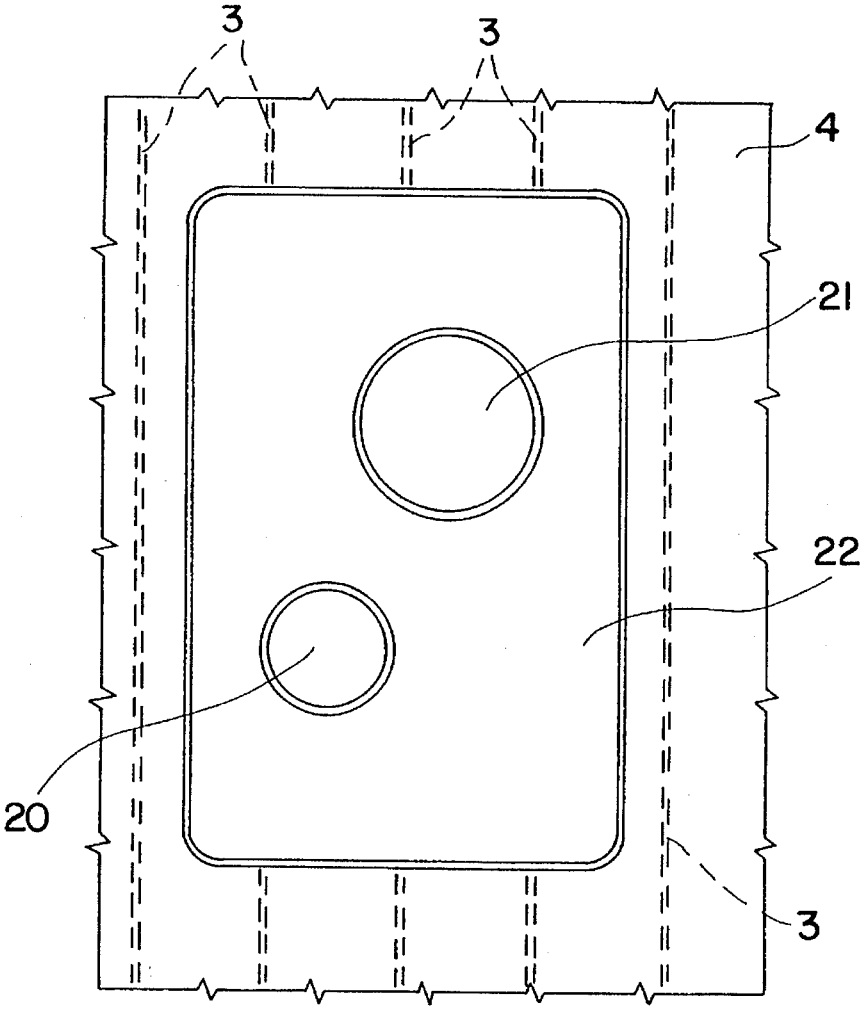
FIG. 5 is the plan view of the arrangement according to FIG. 4.

FIG. 5 shows a diagrammatic plan view of the region of a plate element 4 provided with a cutout according to FIG. 4. Identical components are denoted by identical reference numerals.

Partial views of a region of a plate element are illustrated in section in FIG. 6 to FIG. 11. The web plate strips 3 have an insulating separation, various embodiments of such separations being illustrated in FIGS. 6 to 11. In each of the embodiments illustrated in FIG. 6 to FIG. 11, a web plate strip 3 consists of two partial strips 3' and 3". Each partial strip is connected to the respectively adjacent outer sheet 1 and 2 by means of a weld 8. At least one profile 27 or 27" or 27'" is inserted between the mutually facing inner longitudinal edges 24 and 25 of the partial strips in accordance with the embodiments according to FIGS. 7 to 11. Each profile 27 consists of an insulating material which, when used for thermal separation, has a low coefficient of thermal conduction.

Figure 6:
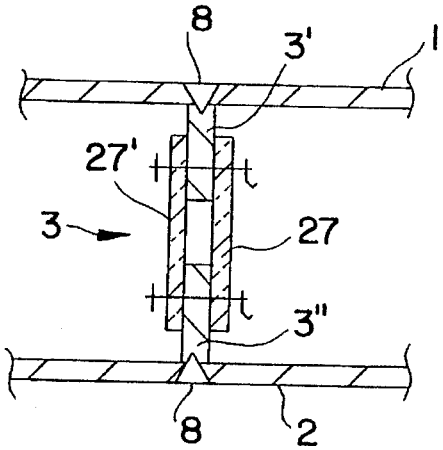
FIG. 6–FIG. 11 are partial views of a plate element in section with various embodiments of a web plate strip with thermal separation.

In the embodiment illustrated in FIG. 6, the insulating separation comprises two profiles 27 and 27' which run parallel to each other and are attached, e.g. by riveting or screwing, to the outside of the partial strips 3' and 3".

Figure 7:
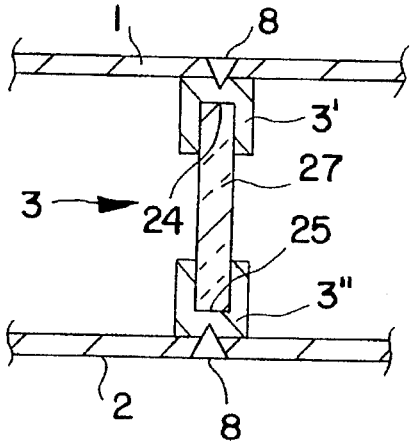

According to the embodiment illustrated in FIG. 7, each partial strip 3' and 3" is of U-shaped design, the longitudinal edges of a profile 27 of insulating material being received as the insulating separation between the U-limbs of the partial strips 3' and 3".

Figure 8:
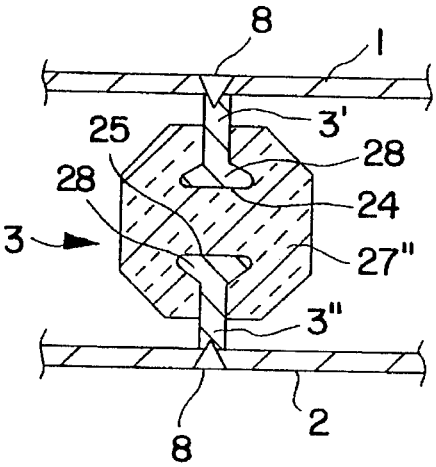

FIG. 8 shows a profile 27" of hexagonal cross-section serving as the insulating separation. The partial strips 3' and 3" have, on the inner longitudinal edges, positive engagement elements 28 in the form of thickenings which engage in a positive-locking manner in correspondingly shaped longitudinal grooves in the hexagonal profile 27".

Figure 9:
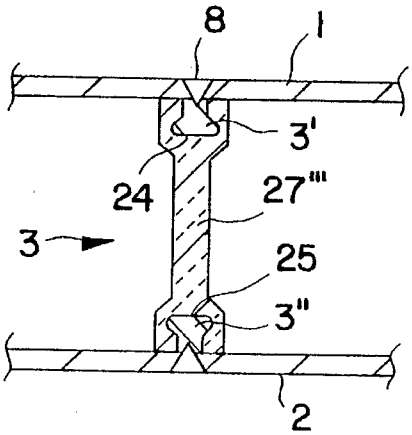

FIG. 9 shows an embodiment which is similar to the embodiment according to FIG. 8. With outer longitudinal edges which are widened in cross-section, a profile 27'" grips around the partial strips 3' and 3" which, in this case, are designed as relatively short stubs with thickenings.

Figure 10:
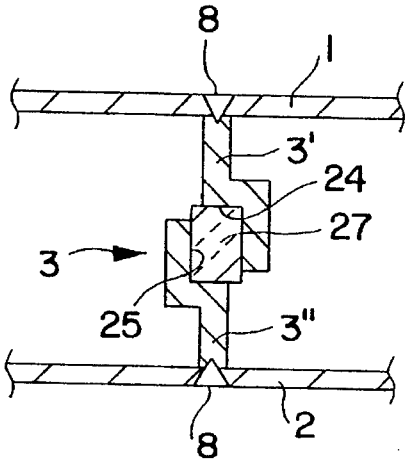
Figure 11:
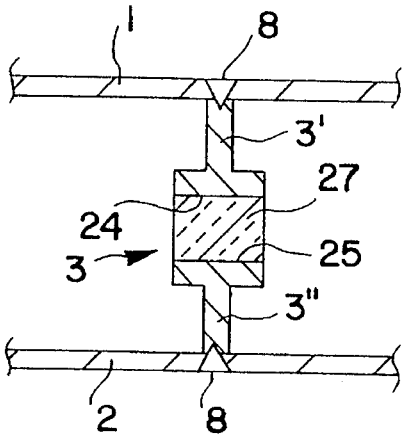

FIG. 10 and FIG. 11 show further design possibilities, the partial strips again being denoted by 3' and 3" and the profile serving as the insulating separation likewise being denoted by 27. In these embodiments, the profile 27 can be bonded to the partial strips 3' and 3".

What is claimed is:

1. A building panel assembly adapted for installation on a lower chord of a support construction comprising:

a steel plate element comprising:

(a) an upper and a lower outer sheet extending in parallel spaced relation to one another, each outer sheet having an inner surface facing the other sheet;

(b) a plurality of web strips interposed between said outer sheets, each web strip having opposite longitudinal edges welded to said inner surfaces of respective outer sheets with a laser weld which passes through each outer sheet to interconnect said outer sheets with one another;

said plate element having a cutout extending therethrough and being adapted to lie across the lower chord with the cutout directly overlying the lower chord; and a tubular support part, having a collar flange and a hollow interior bordered by an inside wall, disposed within the cutout and adapted to be supported by the lower chord and connected thereto by a weld on said inside wall, wherein said collar flange rests on said upper outer sheet and is welded thereto.

2. The building panel assembly according to claim 1, comprising a support beam disposed on and welded to said collar flange so that forces on said support beam are borne directly by the lower chord via said support part.

* * * * *